US005311986A

United States Patent [19]

Putz

[11] Patent Number: 5,311,986

[45] Date of Patent: May 17, 1994

[54] PREMOISTENED WIPE DISPENSER FOR CONVENTIONAL TOILET-TISSUE ROLL HOLDERS

[76] Inventor: Joan M. Putz, 5 Ginger Meadow Ct., Edwardsville, Ill. 62025

[21] Appl. No.: 848,542

[22] Filed: Mar. 9, 1992

[51] Int. Cl.[5] ..... B65D 69/00

[52] U.S. Cl. ..... 206/233; 206/494; 242/55.53; 242/55.2

[58] Field of Search ..... 206/233, 494; 242/55.53, 55.2; 248/214, 311.2

[56] References Cited

U.S. PATENT DOCUMENTS

| | | | |
|---|---|---|---|
| D. 154,933 | 8/1949 | Lestage | 242/55.53 |
| 2,765,909 | 10/1956 | Graham | 206/494 |
| 4,004,687 | 1/1977 | Boone | 206/233 |
| 4,106,616 | 8/1978 | Boone | 206/233 |
| 4,106,617 | 8/1978 | Boone | 206/233 |
| 4,191,317 | 3/1980 | Harkins | 242/55.53 |
| 4,235,333 | 11/1980 | Boone | 206/233 |
| 4,483,491 | 11/1984 | Rainey | 242/55.2 |
| 4,798,312 | 1/1989 | Scheiber | 206/233 |
| 4,807,823 | 2/1989 | Wyant | 242/55.53 |
| 4,978,095 | 12/1990 | Phillips | 248/312 |
| 5,065,936 | 11/1991 | King | 206/494 |
| 5,109,978 | 5/1992 | Cawley | 242/55.53 |

FOREIGN PATENT DOCUMENTS

| | | | |
|---|---|---|---|
| 2113655 | 8/1983 | United Kingdom | 206/233 |

*Primary Examiner*—David T. Fidei

[57] ABSTRACT

A dispensing device for providing premoistened wipes from the conventional toilet-tissue roll holder so that dry and moist cleaning material is available from the same convenient location. The dispensing device comprising an upper container section with sidewalls and backwall extending underneath the container section. Lid exit provided in endwall of the container section for removal of premoistened wipes. Sufficient space provided underneath container section for placement of toilet-tissue roll between the lower sidewalls and backwall. Mounting holes provided in lower sidewalls for mounting the dispenser on the roll holder spindle. The dispensing device conveniently provides premoistened wipes in the space above the toilet-tissue roll.

14 Claims, 3 Drawing Sheets

PREMOISTENED WIPE DISPENSER FOR CONVENTIONAL TOILET-TISSUE ROLL HOLDERS

BACKGROUND OF THE INVENTION

1. Field of the Invention

This invention relates to a dispensing device for premoistened wipes, specifically a dispenser which mounts and attaches to a conventional toilet-tissue roll holder for providing premoistened wipes.

2. Description of the Prior Art

Bathrooms are generally equipped with conventional toilet-tissue roll holders. These holders are designed to support, display, and provide convenient access to the typical toilet-tissue roll. The conventional holder is composed of a telescoping spring biased retractable spindle mounted between a pair of forwardly projecting posts. Bearing sockets are located on the posts which receive the journal ends of the spindle. The toilet-tissue roll is supported by the spindle.

The normal bathroom toilet routine is for using dry toilet-tissue for cleaning. But it has become apparent that this routine is often insufficient for the elevated concern of personal hygiene and personal needs of many individuals. To solve these concerns and needs, products of premoistened tissues, cloths, sheets, wipes, and towelettes are now a common and welcomed consumer product. However, even though premoistened wipes are available, there is no generally accepted or commercially successful dispenser for combining the premoistened wipes and dry toilet-tissue on the conventional toilet-tissue roll holder. Therefore, the consumer available premoistened wipe dispensers are separate stand alone dispensing units which must be placed or stored at inconvenient locations within bathrooms.

By way of representation of the typical prior art structures which have attempted to solve the identified problem, the following U.S. Patents are representative of premoistened wipe dispensers associated with conventional toilet-tissue roll holders.

A number of various patents were issued to Boone in his attempts to find a feasible and workable solution of providing moistened and dry tissue in combination from different types of dispensers. Boone, U.S. Pat. No. 4,004,687 (1977), discloses several dispenser holding devices which attach by sliding them onto one post of a standard roll-type toilet tissue holder for positioning a cylindrical container adjacent to one end of the holder. Similiarly, Boone, U.S. Pat. No. 4,106,616 (1978), reveals several devices which attach by various arm members to a standard toilet-tissue dispenser for positioning containers adjacent to the dispenser. Both of the above referenced patents illustrate awkward means of attachment for holding dispensers, and require additional manufactured hardware and parts for suspending the dispensers. The above mentioned dispensers with their supporting parts are not aesthetically pleasing since they lack visual continuity and balance. Furthermore, these dispensers are deficient in their support means, and lack simplicity for acceptance by consumers.

Boone in both U.S. Pat. No. 4,106,617 (1978) and U.S. Pat. No. 4,235,333 (1980), describes bathroom fixtures which make available both conventional toilet-tissue and supplemental premoistened sheets. The objections to these fixtures are that the consumer must purchase a new expensive and elaborate permanent fixture, incur cost and time expenditures with the installation of a complicated fixture, and discard the useful standard conventional toilet-tissue fixture. A further deficiency of the fixtures by Boone is that the fixtures require approximately twice the mounting space as compared to the conventional fixtures. Therefore, the fixtures that Boone describes do not provide a cost effective solution to the identified problem. Also, Boones' fixtures are not compact and they over utilize the limited space which is available in the proximity of toilets in most bathrooms. Furthermore, tens of millions of existing useful conventional toilet-tissue dispensers would have to be discarded and replaced if the general public accepted Boones' solutions to the problem.

Phillips, U.S. Pat. No. 4,978,095 (1990), illustrates and describes a harness for hitching a moistened-tissue dispenser onto and underneath a conventional toilet-tissue roll holder so that a user has ready access to either type of tissue. The harness as described for supporting the cylindrical dispenser is made from synthetic plastic sheeting. Phillip's invention has deficiencies in function and appearance in providing a workable and acceptable solution to the identified problem. The harness as described would be unable to support the upward removal of tissues from the cylindrical dispenser since the dispenser dangles from the harness. A user would have to inconveniently bend over and hold the dispenser in one hand while removing tissue with the other hand. Also, a user would usually inadvertently touch the dry tissue with the moistened tissue because of the upward removal of tissue from the inferior positioned moistened tissue dispenser. Furthermore, the device by Phillips has an unappealing appearance because of the cylindrical dispenser hanging underneath the toilet-tissue roll holder. This arrangement does not exhibit a harmonious blending of the dispenser and roll holder since it does not appear as a combined and integral dispensing device in combination with the roll holder. Also, Phillips harness must be connected to the dispenser by removing the lid to the premoistened wipe dispenser, fitting the hoop of the harness onto the dispenser, installing the lid back on the dispenser, and then the harness must be hitched to the journal ends of the roll holder. Therefore, the harness is also inconvenient and time consuming in its installation.

Madison, Great Britain Pat. No. 2,113,655 (1983), describes a tissue dispenser so dimensioned and arranged as to supported on and by a bracket of a toilet roll holder. The dispenser as described will only function properly with a toilet roll holder which is specifically designed for use with Madison's dispenser. The majority of roll holders which are in use do not have flattened horizontal surfaces on the top of the posts and the back plate to support the dispenser of Madison. The dispenser also interferes with the unwinding of the toilet tissue roll since it rests on the top of the roll in an awkward tipped forwardly position. Furthermore, Madison shows the toilet tissue roll mounted on the spindle so that the roll will unwind in a counter clockwise direction. If the toilet roll is mounted to unwind in a clockwise direction, Madison's dispenser would ride upward on the roll and would not be held firmly. The dispenser has insufficient support to function satisfactorily if the roll is mounted to unwind clockwise. Therefore, Madison's tissue dispenser has functional deficiencies and it can only be used with a limited number of roll holders.

Harkins in U.S. Pat. No. 4,191,317 (1980) describes a toilet paper unrolling fixture which enables the user to quickly tear a length of toilet paper from the roll. The fixture as described and illustrated by Harkins is incapable of providing supplemental products such as premoistened wipes and other accessory toiletry products from the toilet tissue roll holder. Harkins does not teach, show, or suggest that his fixture can be redesigned and used for solving other problems.

SUMMARY OF THE INVENTION

Objects and Advantages

A primary object of the present invention is to provide an improved dispenser for premoistened wipes which allows their placement in combination with roll toilet-tissue on the conventional toilet-tissue roll holder. Several of the objects and advantages of the present invention are:

(a) to provide a dispenser which requires no alterations or extra parts and hardware added to the conventional toilet-tissue roll holder.

(b) to provide a dispenser which uses the existing conventional toilet-tissue roll holder for support and display.

(c) to provide a dispenser which is easily installed.

(d) to provide a dispenser which is compact, and utilizes space and the existing roll dispenser efficiently.

(e) to provide a dispenser that uses the space above the toilet-tissue holder to prevent interference with the dispensing of the toilet tissue.

(f) to provide a dispenser which is simple in design and can be manufactured at minimal cost.

(g) to provide a dispenser that is not permanent and is interchangeable.

(h) to provide a dispenser that can convert existing conventional toilet-tissue roll holders to multi-functioning devices.

(i) to provide a dispenser which provides convenience, saves time, and puts the product at point of use.

Further objects and advantages are to provide a dispenser that is aesthetically pleasing, and has visual continuity and balance, which can be made disposable or reusable, which combines with the conventional toilet-tissue roll holder as an integral dispensing device, and which obviates the need to purchase a new bathroom fixture. Another object is to provide a dispenser which the general consumer will accept in solving the identified problem. Still further desirable objects achieve and advantages obtained will become apparent from consideration of the ensuing description and drawings.

BRIEF DESCRIPTION OF THE DRAWINGS

Drawing Figures

For a fuller understanding of the invention, reference should be made to the following detailed description in conjunction with the accompanying drawings in which.

Reference Numerals in Drawings

Figure 1:
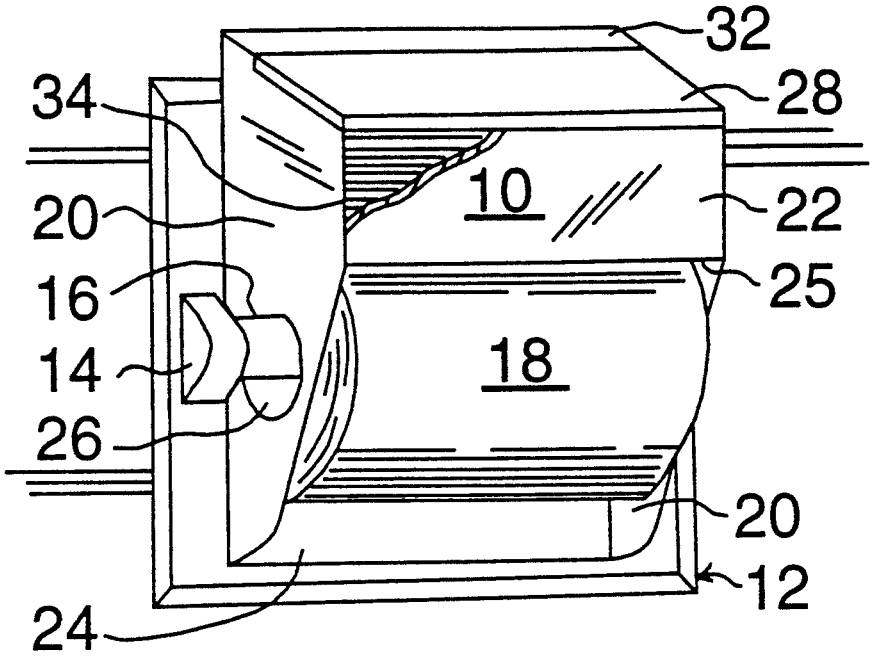
FIG. 1 is a perspective view of the dispensing device mounted on a conventional roll supporting structure. A partially broken away view is provided to illustrate premoistened wipes in the container portion of the device.

10. dispensing device
12. conventional toilet-tissue roll holder
14. post
16. spindle
18. toilet-tissue roll
19. container
20. sidewall
22. frontwall
24. backwall
25. base
26. hole
27. slanted and elongated hole
28. lid
29. slotted exit
30. aperture
31. cap
32. endwall
34. premoistened wipes
36. crease
38. removable container

DETAILED DESCRIPTION OF THE INVENTION

Description—FIGS. 1 to 7

In FIG. 1 there is illustrated one form of a dispensing device 10 mounted on a conventional toilet-tissue roll holder 12. The typical wall mounted roll holder includes a pair of forwardly projecting posts 14. Each post 14 having a bore to receive the ends of a removable telescoping spring-biased retractable spindle 16. A toilet-tissue roll 18 is supported on spindle 16 between a pair of posts 14. Dispensing device 10 has a frontwall 22, base 25, and endwall 32 which define the width, depth, and height of the interior of a container 19 (FIG. 2) of the device. In FIG. 1, sidewalls 20 and backwall 24 extend downward from the container section of the device. Each sidewall 20 having a hole 26 in the lower portion for mounting on spindle 16. Width between sidewalls 20 sufficient for placing a standard toilet-tissue roll 18. Endwall 32 with a lid 28 for providing an exit for premoistened wipes 34 from the container portion of the device. Base 25 and endwall 32 connected to sidewalls 20, backwall 24, and frontwall 22. Sidewalls 20 connected to backwall 24 and frontwall 22.

Figure 2:
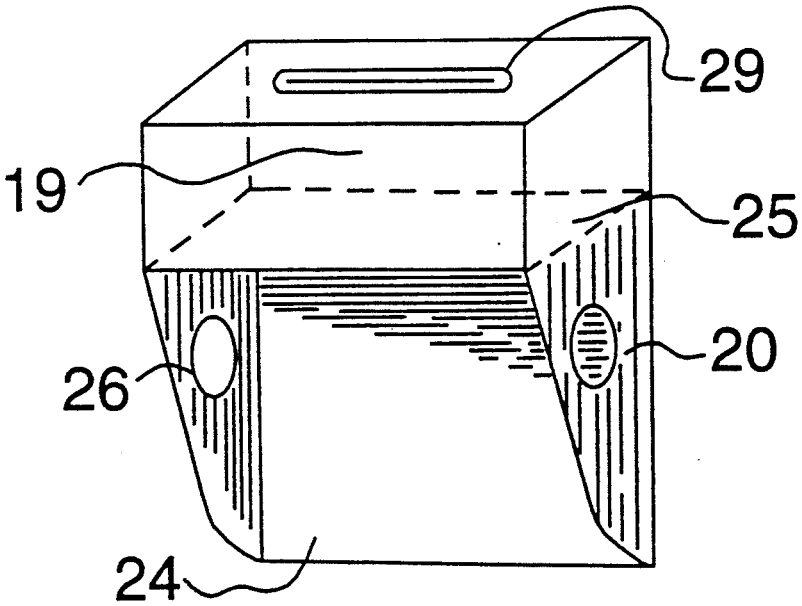
FIG. 2 is a perspective view of the dispensing device showing a slotted exit in the endwall for removal of dry tissue.

FIG. 2 (perspective view) shows the dispensing device with a slotted exit 29 in the endwall which would be more suitable for dispensing of a dry paper good such as tissues.

Figure 3:
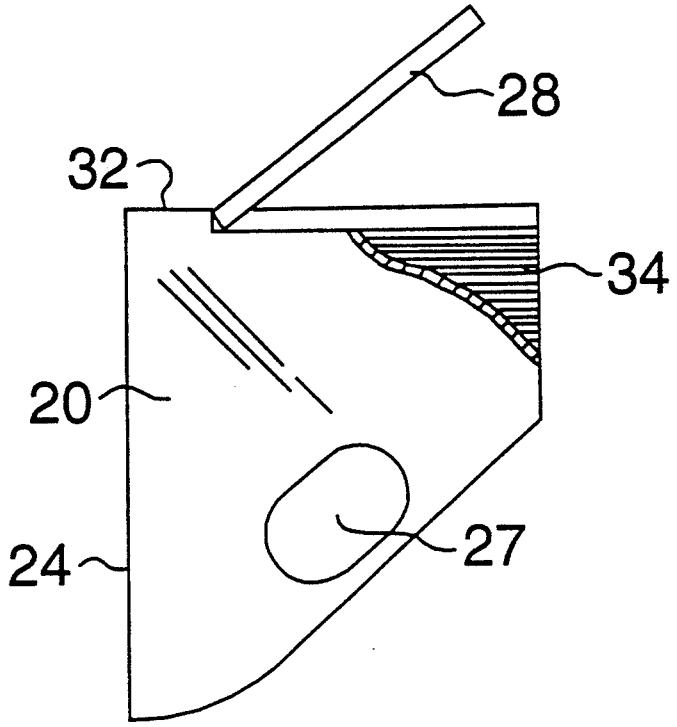
FIG. 3 is a side view of the dispensing device with a partially broken away view showing premoistened wipes in the container portion of the device. Also, illustrated is the lid exit open and a different shaped mounting hole in the sidewall of the device.
Figure 4:
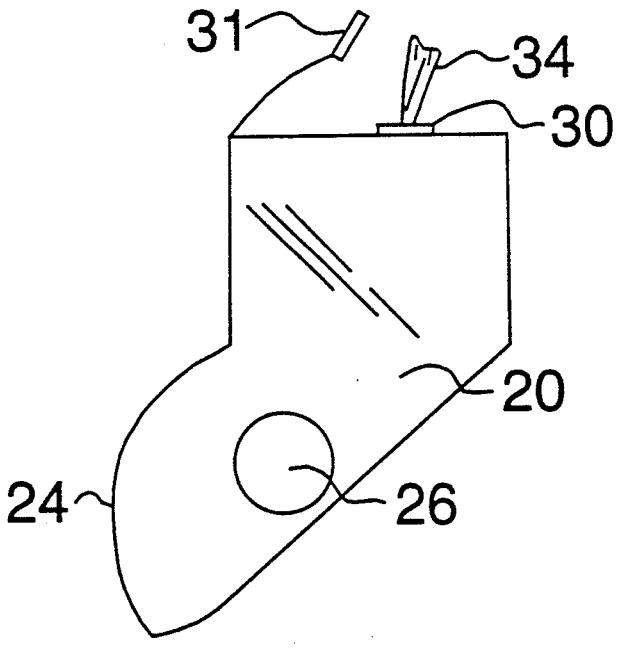
FIG. 4 is a side view of another embodiment of the dispensing device for recessed conventional toilet-tissue roll holders.

The embodiments shown in FIG. 3 and FIG. 4 are side views of the dispensing device. FIG. 3 displays a slanted and elongated mounting hole 27 in sidewall 20, and backwall 24 is vertical. FIG. 4 illustrates an aperture 30 for removal of premoistened wipes. Cap 31 opens, closes, and seals aperture 30 exit. In FIG. 4, backwall 24 and sidewall 20 have a curvature in the lower portion for accommodating partially recessed roll holders.

Figure 5:
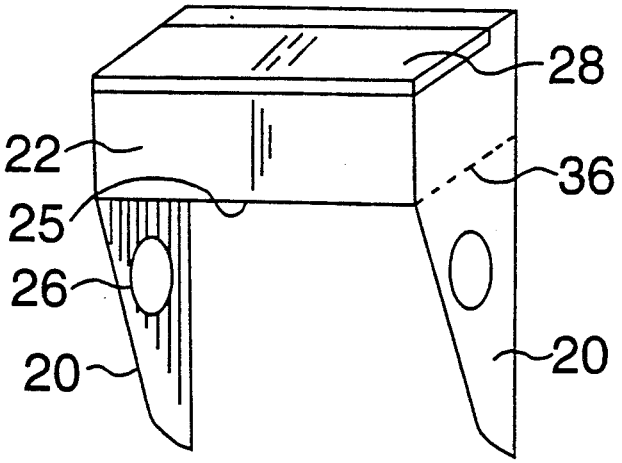
FIG. 5 is a perspective view of another embodiment of the dispensing device which illustrates the lower sidewalls can be folded underneath the container portion.

In FIG. 5 another embodiment of the dispensing device is shown, where backwall 24 depth terminates at the base. Sidewalls 20 have a folding crease 36 at the bottom edge of base 25 which allows lower portion of sidewalls 20 to be folded underneath base 25. Therefore, dispensing device elongated sidewalls 20 may be folded underneath base 25 or can be extended to the vertical position.

Figure 6:
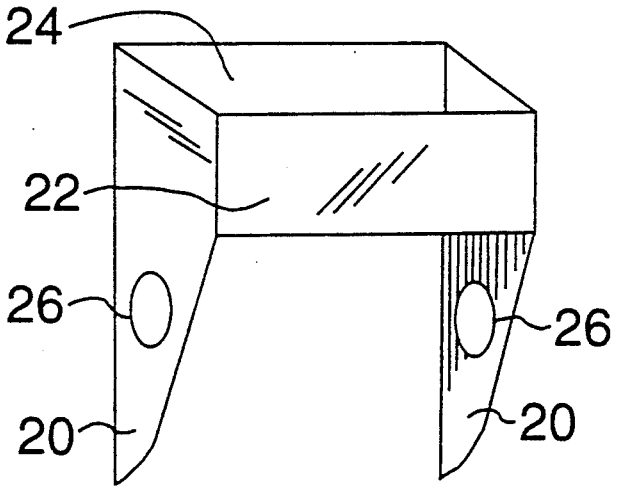
FIG. 6 is a perspective view of the support structure of the dispensing device for receiving and holding a removable container.
Figure 7:
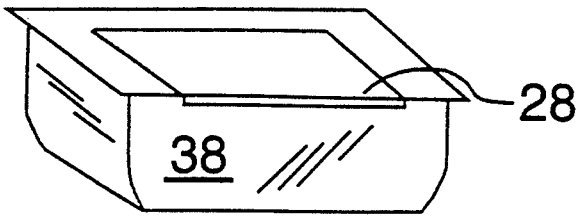
FIG. 7 is a perspective view of a removable container.

The embodiment of the dispensing device in FIG. 6 illustrates the support structure. This variation of the device does not contain base 25 and endwall 32. This support structure would be able to receive a removable container 38 as shown in FIG. 7.

From the description above, a number of advantages of the dispensing device become evident:

(a) The design of the dispensing device allows it to be mounted on the toilet-tissue roll holder as easily as a roll of toilet-tissue.

(b) The dispenser provides premoistened wipes in the space above the conventional toilet-tissue roll holder. This prevents interference with the dispensing of the dry toilet-tissue roll paper.

(c) The dispenser does not require the purchase of parts and hardware or cumbersome modifications to the existing roll holder.

(d) The dispenser provides convenience, saves time, and puts the product at point of use with the dry toilet-tissue.

(e) Manufacturing costs of the dispenser will be economical because of the simple design.

(f) The dispensing device is compact, and efficiently uses the limited space found in most bathrooms.

(g) The design of the dispenser is attractive and forms an integral dispensing device with the roll holder.

(h) The dispensing device can be mounted on the existing conventional toilet-tissue roll holder which prevents the purchase and installation of a new multi-functioning bathroom dispenser.

(i) When medical and hygiene reasons dictate the need for the use of premoistened wipes, the dispenser can be readily added to the conventional toilet-tissue roll holder.

Operation—FIGS. 1 to 7

The method for mounting of dispensing device 10 as shown in FIG. 1 is similiar to mounting toilet-tissue roll 18 on conventional toilet-tissue roll holder 12. Toilet-tissue roll 18 is aligned between sidewalls 20 of dispensing device 10. Spindle 16 is then inserted through hole 26 in sidewall 20, through toilet-tissue roll 18, and then through hole 26 in opposite sidewall 20. With frontwall 22 facing outward, the ends of spindle 16 are then placed in posts 14 of roll holder 12. This completes the mounting of dispensing device 10 and toilet-tissue roll 18 on the conventional toilet-tissue roll holder. This places premoistened wipes 34 conveniently in the same location as the toilet tissue roll. Premoistened wipes 34 can be removed from the container section by lid 28 or aperture 30 exits of the dispensing device as illustrated in FIGS. 3 and 4, respectively. Slotted exit 29 in endwall 32 of FIG. 2 would be suitable for removal of dry tissue from the dispensing device. Slanted and elongated mounting hole 27 as shown in FIG. 3 would compensate for size variations found in conventional toilet-tissue roll holders. Slanted and elongated mounting holes 27 would allow dispensing device 10 to slide against the roll holder or the vertical structure the roll holder is mounted on. This would provide additional support for the dispenser.

In FIG. 5, the dispenser has the lower backwall below base 25 eliminated and lower sidewalls 20 can be folded at a bendable crease 36 immediately underneath base 25. This would allow the dispensing device to be placed on a flat surface such as a shelf, when sidewalls 20 are folded underneath base 25. Or the sidewalls could be extended to the vertical position and the dispenser mounted on the roll holder. This design would allow for compact packaging and shipping of the dispenser by the manufacturer.

The embodiment of the dispenser in FIG. 6 can receive removable container 38 as illustrated in FIG. 7. Removable container 38 can be dropped or slid into the upper portion of the dispensing device since the device in FIG. 6 does not contain the endwall and base. This allows for the replacement of container 38 as needed, when the supply of tissues or premoistened wipes are exhausted. The design of FIG. 6 would prevent the consumer from having to repeatedly purchase the supportive structure of the dispensing device.

The dispensing device may be constructed of metal, plastic, ceramic, or paper materials. Metal, ceramic, and certain plastic constructions of the dispenser would make it reusable. Whereas, paper and other plastic constructions would make the dispenser expendable after use.

Summary, Ramifications, and Scope

The dispensing device of the invention provides premoistened wipes on the conventional toilet-tissue roll holder in a simple, economical, efficient, and convenient manner. The dispenser attractively uses the existing roll holder for support and display. When mounted on the roll holder, the dispenser is compact and changes the roll holder to a multi-functioning device. The space above the roll holder is used which prevents interference with the dispensing of the dry roll toilet-tissue. The dispenser requires no alterations or extra parts and hardware added to the roll holder to function properly. The dispenser is easily installed and can be manufactured at minimal cost. When hygiene or personal needs dictate, the dispenser can be added to the toilet-tissue roll holder to save time and to put the premoistened wipes at the point of use. The dispenser is not permanent and is interchangeable. When combined with the conventional toilet-tissue roll holder it forms an integral dispensing device, and obviates the need to purchase a new elaborate bathroom fixture. The dispensing device provides premoistened wipes on the conventional toilet-tissue roll holder which is presently not available to the consumer.

Although the description above contains many specificities, these should not be construed as limiting the scope of the invention but merely as providing illustrations of some of the presently preferred embodiments of this invention. Many other variations are possible. For example, the mounting holes in the lower sidewalls of the dispenser could be square, rectangular, or triangular in shape. The dispensing device could contain other toiletry products such as sanitary pads, tampons, and cleansing lotions. The dispensing device may be prepackaged with a roll of toilet-tissue mounted between the lower sidewalls. Such an embodiment could be mounted on the conventional roll holder or could be a stand alone unit. This type of dispenser would be useful in locations away from modern toilet facilities such as in camping or primitive toilet situations. Different styles and sizes of apertures and lids for the removal of products from the dispenser are contemplated. The dispenser has been described for occupying the space above the roll holder. But the dispenser could easily be inverted and modified for use in the space below the conventional roll holder. This embodiment would be practical where the space above the roll holder is limited. Although the invention has been described for use with the conventional toilet-tissue roll holder, the dispenser could be enlarged for use on the paper towel roll holders found in most kitchens.

Thus the scope of the invention should be determined by the appended claims and their legal equivalents, rather than by examples given.

I claim:

1. A dispensing device to be mounted on a roll holder, said device comprising:

a. a container including a base, an opposed frontwall and backwall connected to said base, a pair of opposed sidewalls connected to said base, said frontwall and said backwall wherein said frontwall, said backwall and said sidewalls upstanding from said base and including a coplanar top edge, an endwall parallel to said base and connected to said backwall, said frontwall, and said sidewalls, b. said base, said frontwall, said backwall, said sidewalls and said endwall define he boundaries of a hollow interior of said container, c. said endwall having an exit means for removal of material from said container, d. said backwall and said sidewalls extend downward from said base with sufficient area provided between said backwall and said sidewalls and below said base for replacement of rolled paper product, and e. said sidewalls below said base having a pair of coaxial aligned holes for mounting on a roll holder.

2. The device as in claim 1 wherein said container holds premoistened wipes.

3. The device as in claim 1 wherein said exit means comprises a lid mounted to said container.

4. The device as in claim 1 wherein said coaxial aligned holes are substantially elliptical.

5. The device as in claim 1 wherein said exit means comprises an aperture.

6. The device as in claim 1 wherein said backwall and said sidewalls below said base extend backward to accommodate the shape of a recessed roll holder.

7. The device as in claim 1 wherein said container holds supplemental toiletry products.

8. A dispensing device to be mounted on a roll holder, said device comprising:

a. a container including a base, an opposed frontwall and backwall connected to said base, a pair of opposed sidewalls connected to said base, said frontwall and said backwall wherein said frontwall, said backwall and said sidewalls upstanding from said base and including a coplanar top edge, an endwall parallel to said base and connected to said backwall, said frontwall, and said sidewalls, b. said base, said backwall, said sidewalls and said endwall define the boundaries of a hollow interior of said container, c. said endwall having an exit means for removal of material from said container, d. said sidewalls extend downward from said base with sufficient area provided between said sidewalls and below said base for placement of rolled paper product, and e. said sidewalls below said base having a pair of coaxial aligned holes for mounting on a roll holder.

9. The device as in claim 8 wherein said container holds premoistened wipes.

10. The device as in claim 8 wherein said exit means comprises a lid mounted to said container.

11. The device as in claim 8 wherein said coaxial aligned holes are substantially elliptical.

12. The device as in claim 8 wherein said dispensing device is mounted on a paper towel holder.

13. The device as in claim 8 wherein said sidewalls have a fold line which permits a lower sidewall portion to be folded underneath said base.

14. The device as in claim 8 wherein said container holds supplemental toiletry products.

* * * * *